US005802498A

United States Patent [19]

Comesanas

[11] Patent Number: 5,802,498

[45] Date of Patent: Sep. 1, 1998

[54] COMPUTER-AIDED PREPAID TRANSMITTAL CHARGE BILLING SYSTEM

[76] Inventor: Jorge Comesanas, 3302 W. Caracas Ave., Tampa, Fla. 33614

[21] Appl. No.: 585,117

[22] Filed: Jan. 11, 1996

[51] Int. Cl.[6] ..... G07B 17/02

[52] U.S. Cl. ..... 705/34

[58] Field of Search ..... 705/22, 28, 29, 705/34, 40, 44

[56] References Cited

U.S. PATENT DOCUMENTS

| | | | |
|---|---|---|---|
| 5,121,945 | 6/1992 | Thompson et al. | 283/58 |
| 5,287,270 | 2/1994 | Hardy et al. | 364/408 |
| 5,341,290 | 8/1994 | Lu | 364/408 |
| 5,510,992 | 4/1996 | Kara | 364/464.02 |
| 5,649,117 | 7/1997 | Landry | 395/240 |

OTHER PUBLICATIONS

Goldman, John, Expedyne Strategic Billing Services Launched, Newswire, pp. 1–2, Jun. 16, 1993.

Bellsouth, Cincinnati Bell: Billing Agents for Hire, Telco Business Report, Dec. 6, 1993.

*Primary Examiner*—Kevin J. Teska
*Assistant Examiner*—Matthew Loppnow
*Attorney, Agent, or Firm*—Dorothy S. Morse

[57] ABSTRACT

A computer-aided billing system which directs the printing of customer invoices to include current billing information and transmittal charges for a pre-paid return envelope which the debtor will receive with the invoice for use in return of the invoice payment and which also directs collation or assembly of the pre-paid return envelope, the invoice, and the shipping envelope in which the invoice and pre-paid return envelope will be sent to the debtor. The computer-aided billing system contemplates debtor agreement to pay the transmittal charges and the possibility of future transmittal charges for electronic transmittal of invoices and invoice payments. Applications include, but are not limited to, use by banking institutions and credit card companies.

9 Claims, 2 Drawing Sheets

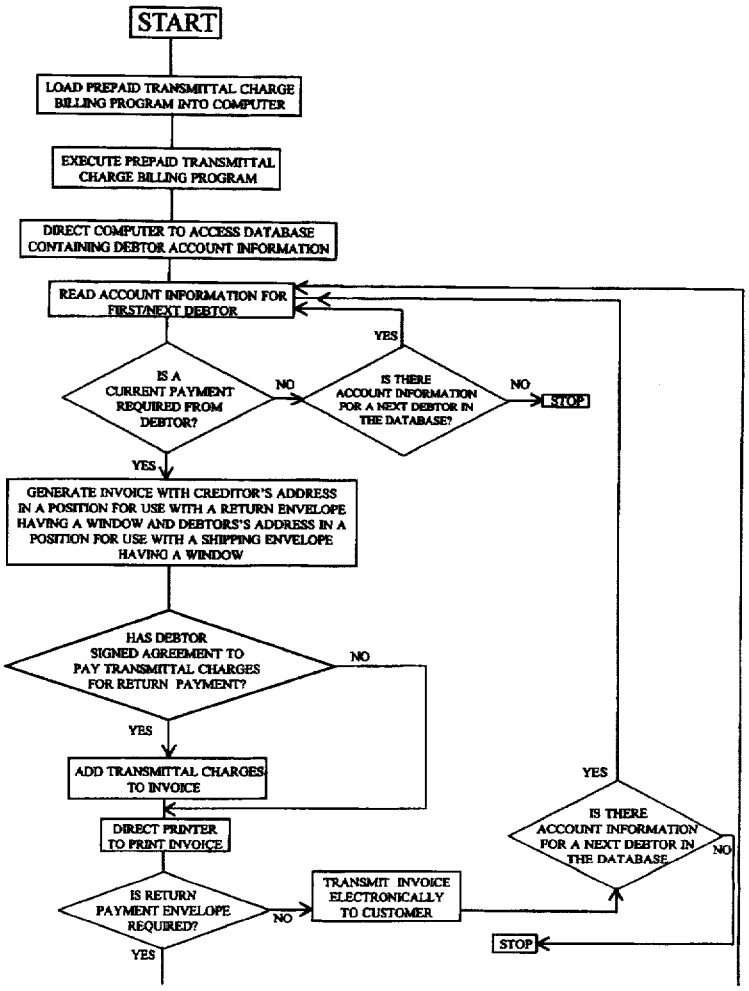

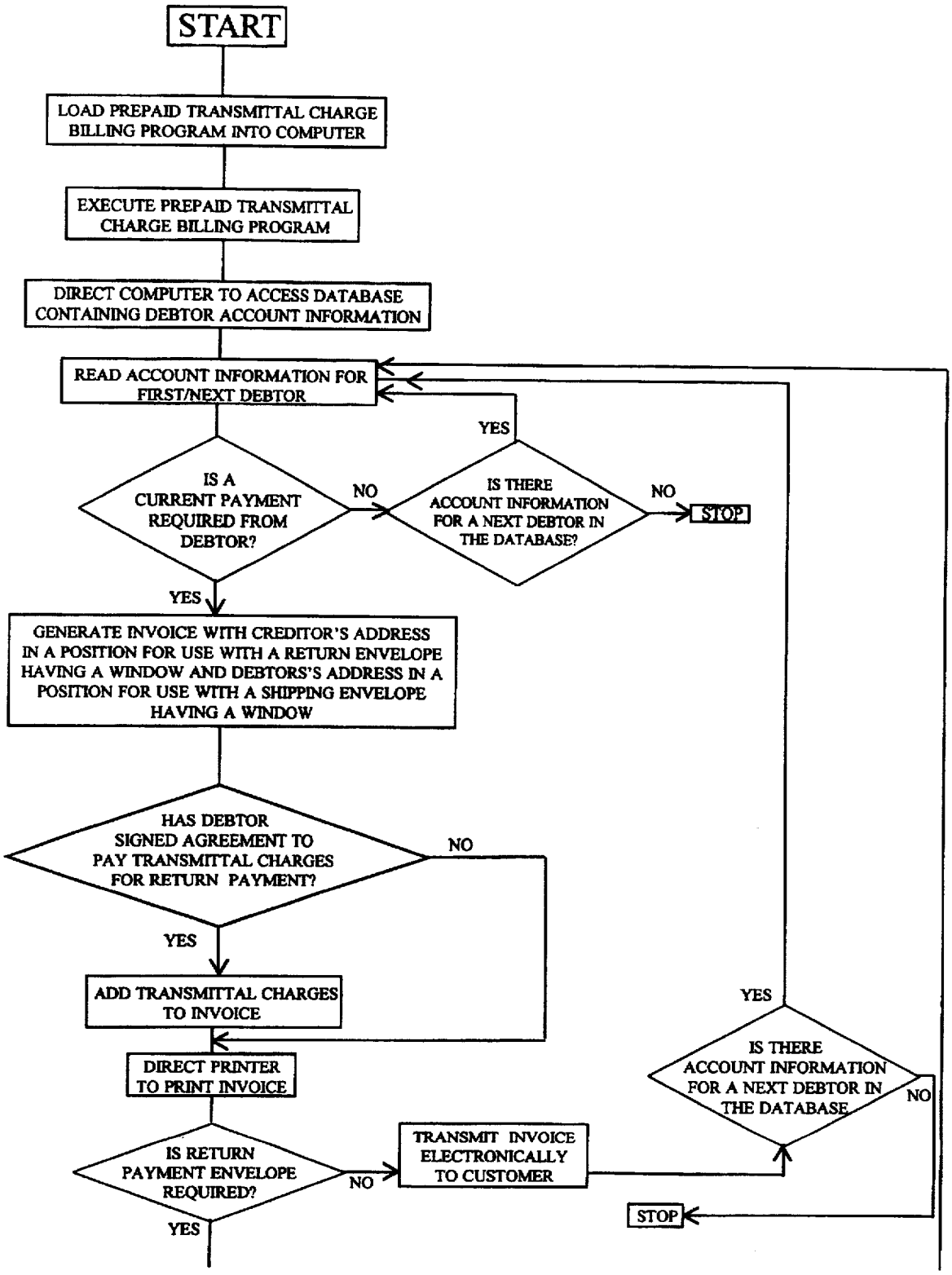
START
LOAD PREPAID TRANSMITTAL CHARGE BILLING PROGRAM INTO COMPUTER
EXECUTE PREPAID TRANSMITTAL CHARGE BILLING PROGRAM
DIRECT COMPUTER TO ACCESS DATABASE CONTAINING DEBTOR ACCOUNT INFORMATION
READ ACCOUNT INFORMATION FOR FIRST/NEXT DEBTOR
IS A CURRENT PAYMENT REQUIRED FROM DEBTOR?
NO
IS THERE ACCOUNT INFORMATION FOR A NEXT DEBTOR IN THE DATABASE?
YES
NO
STOP
YES
GENERATE INVOICE WITH CREDITOR'S ADDRESS IN A POSITION FOR USE WITH A RETURN ENVELOPE HAVING A WINDOW AND DEBTORS'S ADDRESS IN A POSITION FOR USE WITH A SHIPPING ENVELOPE HAVING A WINDOW
HAS DEBTOR SIGNED AGREEMENT TO PAY TRANSMITTAL CHARGES FOR RETURN PAYMENT?
NO
YES
ADD TRANSMITTAL CHARGES TO INVOICE
DIRECT PRINTER TO PRINT INVOICE
IS RETURN PAYMENT ENVELOPE REQUIRED?
NO
YES
TRANSMIT INVOICE ELECTRONICALLY TO CUSTOMER
IS THERE ACCOUNT INFORMATION FOR A NEXT DEBTOR IN THE DATABASE
YES
NO
STOP

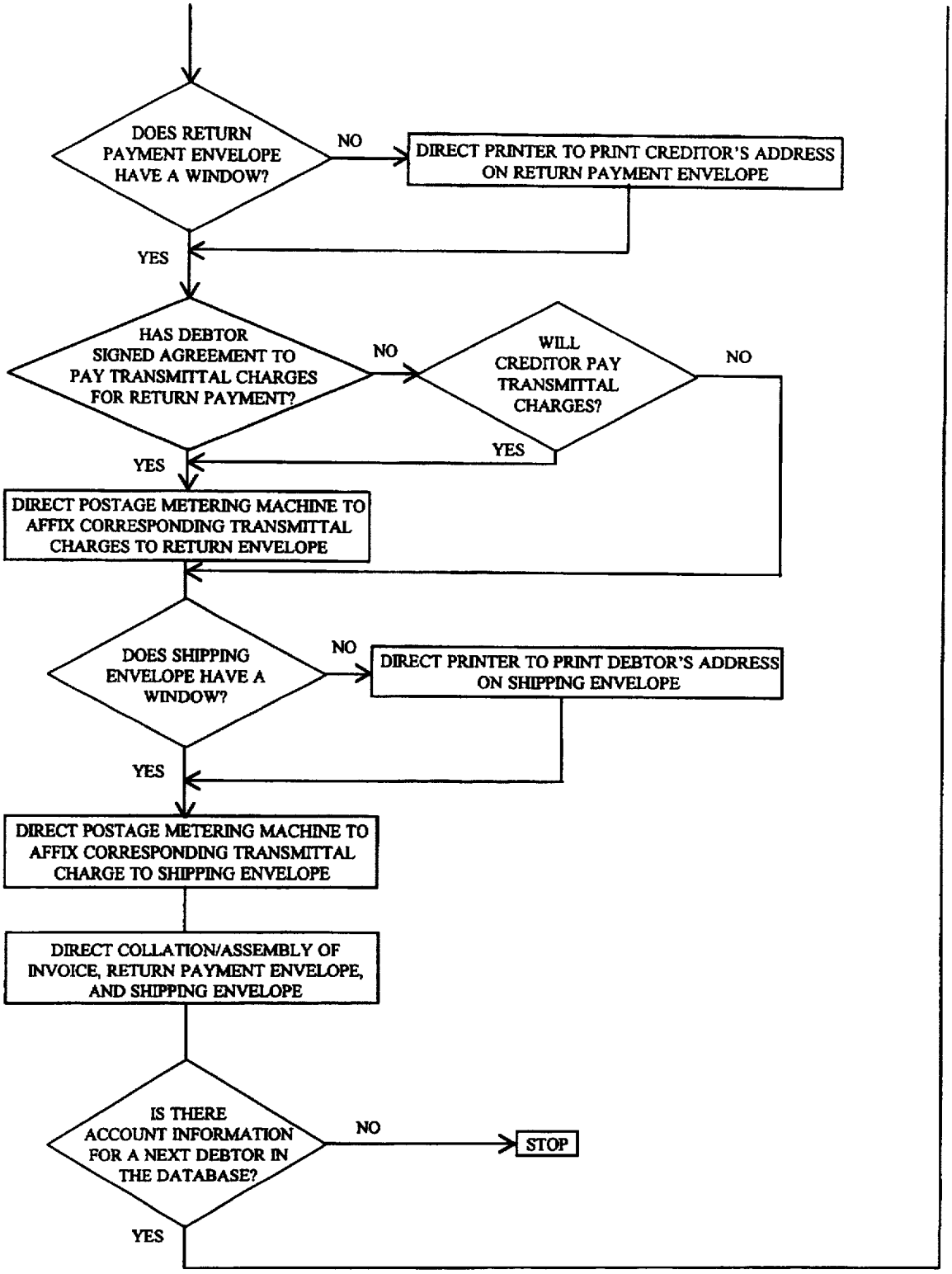
DOES RETURN PAYMENT ENVELOPE HAVE A WINDOW?
NO
DIRECT PRINTER TO PRINT CREDITOR'S ADDRESS ON RETURN PAYMENT ENVELOPE
YES
HAS DEBTOR SIGNED AGREEMENT TO PAY TRANSMITTAL CHARGES FOR RETURN PAYMENT?
NO
WILL CREDITOR PAY TRANSMITTAL CHARGES?
NO
YES
YES
DIRECT POSTAGE METERING MACHINE TO AFFIX CORRESPONDING TRANSMITTAL CHARGES TO RETURN ENVELOPE
DOES SHIPPING ENVELOPE HAVE A WINDOW?
NO
DIRECT PRINTER TO PRINT DEBTOR'S ADDRESS ON SHIPPING ENVELOPE
YES
DIRECT POSTAGE METERING MACHINE TO AFFIX CORRESPONDING TRANSMITTAL CHARGE TO SHIPPING ENVELOPE
DIRECT COLLATION/ASSEMBLY OF INVOICE, RETURN PAYMENT ENVELOPE, AND SHIPPING ENVELOPE
IS THERE ACCOUNT INFORMATION FOR A NEXT DEBTOR IN THE DATABASE?
NO
STOP
YES

COMPUTER-AIDED PREPAID TRANSMITTAL CHARGE BILLING SYSTEM

BACKGROUND

1. Field of Invention

This invention relates to computer programs, specifically to computer software which directs the printing of customer invoices to include current billing information and transmittal charges for a pre-paid return envelope which the customer will receive with the invoice for use in return of the invoice payment and which also directs collation or assembly of the pre-paid return envelope, the invoice, and the shipping envelope in which the invoice and pre-paid return envelope will be sent to the customer. Applications include, but are not limited to, use by banking institutions and credit card companies.

2. Description of Prior Art

It is well known for individuals, companies, and non-profit corporations desiring return correspondence to include a self-addressed return envelope in the shipping envelope used to send the original correspondence. Prompt return correspondence may be enhanced by enclosing a pre-paid return envelope in the shipping envelope. The entity desiring return correspondence may affix a stamp or a metered mail label to the pre-paid envelope. When a pre-paid envelope has a stamp on it, whether or not the envelope is used, the entity desiring the return correspondence has had to incur the cost of the return transmittal charge. In the event that a metered mail label is used, the entity will only incur the cost of the return transmittal charge if the return envelope is used. Either way, the entity incurs return transmittal charges, which might otherwise be passed along to the recipient of the correspondence. It is not known to have a computer software billing system which directs the printing of customer invoices to include current billing information By and transmittal charges for a pre-paid return envelope which the customer has approved through prior written agreement,and will receive with the invoice for use in return of an invoice payment, the system or assembly of the pre-paid return envelope, the invoice, and the shipping envelope in which the invoice and pre-paid return envelope will be sent to the customer.

SUMMARY OF INVENTION—OBJECTS AND ADVANTAGES

It is the primary object of this invention to provide a computer software billing system which directs the printing of customer invoices to include current billing information and transmittal charges for a pre-paid return envelope which the customer will receive with the invoice for use in return of the invoice payment. It is a secondary object of this invention to provide a computer software billing system which also directs collation or assembly of the pre-paid return envelope, the invoice, and the shipping envelope in which the invoice and the pre-paid return envelope will be sent to a customer. A further object of this invention is to provide a computer software billing system for businesses which offers a time saving service to its customers in the form of a pre-paid return envelope to save each customer the time it would take to procure and place a stamp on the return envelope. It is also an object of this invention to provide a means by which banking institutions and credit card companies may expedite the return of invoice payments.

As described herein, properly manufactured and used, the present invention would provide an automated, computer-directed means by which banking institutions and credit card companies may attempt to expedite the return of invoice payments. With transmittal charges already affixed to the return envelope, a customer does not have to delay return of an invoice payment for want of a stamp. As a secondary advantage the present invention would provide a service for the customer by providing the customer with a prepaid return envelope for each invoice payment. The present invention would provide a computer-aided billing system which directs a printer to print the current billing informaton for a customer onto an invoice. Then the computer would the review database records to see if the customer had signed an agreement that authorizes billing for transmittal charges associated with the providing of a prepaid return envelope. If so, the computer would. Direct a printer to print transmittal charges onto the invoice for a pre-paid return envelope which the customer will receive with the invoice for use in return of the invoice payment. After compiling the invoicing informaton and directing the printing of paper invoice, the computer would direct printers to address the prepaid return envelope,as well as the shipping envelope in which the invoice and pre-paid return envelope will be sent to the customer, and direct a postage metering machine to affix transmittal charges onto the pre-paid return envelope and the shipping envelope, either printed directly onto the envelopes or by use of label. Finally, the computer would direct collation or assembly of the pre-paid return envelope, the shipping envelope, and the invoice for transmittal to the customer.

The description herein provides preferred embodiments of the present invention but should not be construed as limiting the scope of the computer-aided billing system invention. Variations in the respective order of some billing system steps, the time taken to perform each of the steps, and the addition of other non-critical steps between each of the billing system steps in the present invention, other than those shown and described herein, may be incorporated into the present invention. Thus the scope of the present invention should be determined by the appended claims and their legal equivalents, rather than the examples given.

BRIEF DESCRIPTION OF THE DRAWINGS

FIG. 1 and 2 illustrate a flowchart which identifies the sequence of operations which the invention must perform.

DETAILED DESCRIPTION OF PREFERRED EMBODIMENTS

As shown in the flowchart accompanying this application, the present invention provides an automated, computer-directed means by which banking institutions and credit card companies may attempt to expedite the return of invoice payments. At the same time the present invention provides a service for customers by providing the customer with a time saving pre-paid envelope for return of an invoice payment. In the preferred embodiment, after the computer software billing system is properly loaded into the computer memory and executed, the computer would access a database containing debtor account information. Then after reviewing information presented for the first debtor account, the computer would decide whether a payment was required for that debtor, and, if so, generate an invoice for the first debtor account so that the creditor's address is in a consolidated position on the invoice for use with a return envelope having a window and so that the debtor's current address is also in a consolidated position on the invoice for use with a shipping envelope having a window. The computer would then determine from the information in the database whether or not the first debtor has signed an agreement to pay transmittal charges associated with a return envelope. If the debtor has signed such an agreement, the transmittal charges would be added to the invoice. The computer would then direct a printer to print an invoice for the first debtor. In a second embodiment of the present invention (not shown), it is contemplated for a creditor have the option to eliminate the step of printing a paper copy of the invoice when the invoice information is electronically transmitted to the debtor.

Transmittal of the invoice to each debtor is contemplated in two ways. In today's business environment a shipping envelope is routinely required. However, in the future, it is contemplated for transmittal of invoices and invoice payments to be accomplished electronically and for the existence of transmittal charges for such electronic transmittal. The present invention can be used in an all-electronic business environment whereby, for the debtor's convenience in being allowed to make return payments electronically, the debtor signs a print written agreement that he authorizes being billed on his or her invoice for electronic transmittal charges that would otherwise be incurred by the creditor for such electronic return payment and for which the creditor would be unwilling to pay Should envelopes be required, the computer will determine whether an address is needed for either the shipping envelope or the pre-paid return envelope. If addresses are required, the computer will direct a printer to print the creditor's address on the pre-paid return envelope and the debtor's current address on the shipping envelope. It is not critical to the present invention which envelope is printed first. The computer will then direct a postage metering device to print transmittal charges onto the shipping envelope and onto the return envelope as needed. Again, it is not critical to the present invention which envelope is printed first. The computer-aided billing system will then have the computer direct the collation or assembly of the pre-paid return envelope, the shipping envelope, and the invoice for transmittal to the customer. This process is repeated for each successive debtor in the database. As the operating speeds of printers and postage metering devices are variable, the order of the steps included herein may be varied to the extent necessary to maximize the efficiency of each printer and each postage metering device used by a creditor without departing from the fundamental intent of the present invention.

What is claimed is:

1. A computer-aided method for preparing at least one invoice having account information and appropriate transmittal charges, at least one shipping envelope, and at least one pre-paid return envelope and collation thereof, said computer-aided method comprising the steps of providing a computer program for preparing and collating invoices with pre-paid transmittal charges, shipping envelopes, and pre-paid return envelopes, at least one computer database with debtor account information for a plurality of debtors which includes a mailing address for each of said debtors, at least one computer having adequate memory for executing said computer program and for storing said database, at least one printer interfaced with said computer, at least one postage metering device interfaced with said computer, a plurality of shipping envelopes, and a plurality of return envelopes; loading said computer program into a selected one of said computers; executing said program; said computer program directing said selected computer to access one of said databases; said selected computer reading debtor account information in said accessed database for a first one of said debtor's; said selected computer generating an invoice for said first debtor from said information read in said first debtor's account; said selected computer determining whether said first debtor signed an agreement to pay transmittal charges for a pre-paid return envelope and if signed, adding said transmittal charges to said first debtor's invoice; said selected computer determining whether one of said shipping envelopes is required for transmittal of said first debtor's invoice to said first debtor and if so directing one of said printers to select one of said shipping envelopes and print on said selected shipping envelope the mailing address of said first debtor in said first debtor's account, said selected computer also directing one of said postage metering devices to affix transmittal charges on said selected shipping envelope when required; said selected computer directing one of said printers to print a paper copy of said invoice; again determining whether said first debtor signed an agreement to pay transmittal charges for a pre-paid return a envelope and if signed, directing one of said postage metering devises to affix transmittal charges on a selected one of said return envelopes to generate a first prepaid return envelope and further if signed directing collation of said first debtor's invoice with said selected shipping envelope and said first pre-paid return envelope; transmitting said first debtor's invoice to said first debtor; and repeating the above-mentioned steps of reading information, generating an invoice, determining whether an agreement was signed, determining whether envelopes are required, and transmitting said invoices for each next debtor in said database to said next debtor until all of said debtor account information in said database has been read and corresponding invoices for those of said debtors from whom a payment is required have been generated by said program.

2. The computer-aided method of claim 1 further comprising a step of one of said computers directing one of Said printers to print a return payment address on each of said prepaid return envelopes.

3. A computer program comprising the steps of directing a computer to access a database containing debtor account information; directing said computer to read said debtor account information for each successive debtor. In said database; compiling current billing information from said debtor account information for selected ones of said debtors from whom a payment is required so as to generate an invoice for each of said selected debtors; determining whether each of said selected debtors has signed an agreement to pay transmittal charges for return payment and if such an agreement was signed, directing said computer to compile said transmittal charges for said return payment into the ones of said invoices generated for each of said selected debtors who had signed such an agreement; determining whether each of said invoices is to be sent electronically or by mail, and if by mail directing a printer to print a paper copy of each of said invoices to be sent by mail: directing said printer to address a return envelope with the address of each of said selected debtors who has signed an agreement to pay transmittal charges for return payment, and fiber directing the collation of an invoices a shipping envelope, and a prepaid return envelope for each of said selected debtors who has signed an agreement to pay transmittal charges for return payment by mail so that said current billing information in said invoices can be transmitted to each of said selected debtors in said database from whom a payment is required.

4.The computer program of claim 3 wherein said step of determining whether each of said selected debtors has signed an agreement to pay transmittal charges for return payment comprises We step of determining whether said return payment is to be made electronically, and if so directing said computer to compile said transmittal charges for said electronic return payment into the ones of said invoices generated, for each of said selected debtors who had signed such an agreement.

5. The computer program of claim 3 further comprising the step of directing a postage metering machine to billing affix proper transmittal charges to said shipping envelope.

6. The computer program of claim 3 further comprising the step of directing said printer to address said prepaid return envelope.

7. The computer program of claim 3 further comprising the step of directing a postage metering machine to affix, proper transmittal charges to said pre-paid return envelope.

8. The computer program of claim 3 wherein said transmitting of said current billing information further comprising the step of directing assembly of said pre-paid envelope, said shipping envelope, and said invoice for transmittal to each of said selected debtors.

9. A computer program comprising the steps of directing a computer to access a database containing debtor account information for a plurality of debtors; directing said computer to read said debtor account information for each of said debtors in said database: compiling current billing information from said debtor account information for each, of said debtors to determine from which of said debtors a payment is required; directing a printer to print said current billing information onto an invoice for each of said selected debtors from whom a payment is required; determining whether each of said selected debtors has signed an agreement to pay transmittal charges for a pre-paid return envelope and if such an agreement was signed directing said printer to print said transmittal charges for a pre-paid return envelope onto said invoice; again determining whether each of said selected debtors has signed an agreement to pay transmittal charges for a pre-paid return envelope and if such an agreement was sign directing said printer to address said pre-paid return envelope, directing said printer to address a shipping envelope in which said invoice and said pre-paid return envelope will be sent to said debtor; directing a postage metering machine to affix proper transmittal charges to said shipping envelope; directing a postage metering machine to affix proper transmittal charges to said pre-paid return envelope; and directing assembly of said prepaid envelope, said shipping envelope, and said invoice for transmittal to each of said selected debtors.

* * * * *

UNITED STATES PATENT AND TRADEMARK OFFICE

CERTIFICATE OF CORRECTION

PATENT NO. : 5,802,498

DATED : September 1, 1998

INVENTOR(S) : Jorge Comesanas

It is certified that error appears in the above-identified patent and that said Letters Patent is hereby corrected as shown below:

Title page, item [76]

The inventor's address should read

-- 707 Teal Avenue, Celebration, FL 34747". --

Column 1, line 40, in the Description of Prior Art, after "payment, the system" *insert* "also directing collation".

Column 2, line 14, after "If so, the computer would" delete ". Direct" *and in its place insert* "direct".

Column 2, line 18, after "the printing of paper invoice" insert "pages".

UNITED STATES PATENT AND TRADEMARK OFFICE

CERTIFICATE OF CORRECTION

PATENT NO. : 5,802,498

DATED : September 1, 1998

INVENTOR(S) : Jorge Comesanas

It is certified that error appears in the above-identified patent and that said Letters Patent is hereby corrected as shown below:

Column 3, line 20, in the Detailed Description, after "debtor signs a" delete "print" *and in its place insert* "prior".

Column 3, line 24, in the Detailed Description, after "unwilling to pay" and prior to "Should envelopes" *insert* a "."

Column 4, line 40, in Claim 3, after "each successive debtor delete ". In" *and in its place insert* "in".

Column 4, line 56, in Claim 3, after "for return payment, and" delete "fiber" *and in its place insert* "further".

Column 4, line 67, in Claim 4, after "payment comprises" delete "We" *and in its place insert* "the".

UNITED STATES PATENT AND TRADEMARK OFFICE

CERTIFICATE OF CORRECTION

PATENT NO. : 5,802,498

DATED : September 1, 1998

INVENTOR(S) : Jorge Comesanas

It is certified that error appears in the above-identified patent and that said Letters Patent is hereby corrected as shown below:

Column 5, line 4, in Claim 4, after "invoices generated" and prior to "for each of said" delete the ","

Column 5, lines 15-16, in Claim 8, after "of Claim 3" and prior to "further comprising" delete "wherein said transmitting of said current billing information".

Column 5, line 24, in Claim 9, after "debtors in said database" and prior to "compiling" delete ":" *and in its place insert* ";"

UNITED STATES PATENT AND TRADEMARK OFFICE

CERTIFICATE OF CORRECTION

PATENT NO. : 5,802,498

DATED : September 1, 1998

INVENTOR(S) : Jorge Comesanas

It is certified that error appears in the above-identified patent and that said Letters Patent is hereby corrected as shown below:

Column 6, line 1, in Claim 9, after "information for each " and prior to "of said" delete ","

Signed and Sealed this

Ninth Day of February, 1999

*Attest:*

*Attesting Officer*

*Acting Commissioner of Patents and Trademarks*